United States Patent [19]

Cooke

[11] 4,327,838

[45] May 4, 1982

[54] CLIP-ON BOOK END

[76] Inventor: John E. Cooke, 2295 Willow La., Lakewood, Colo. 80215

[21] Appl. No.: 123,756

[22] Filed: Feb. 22, 1980

Related U.S. Application Data

[63] Continuation-in-part of Ser. No. 909,639, May 26, 1978, abandoned.

[51] Int. Cl.[3] ..... A47F 5/00

[52] U.S. Cl. ..... 211/184; 108/61

[58] Field of Search ..... 211/43, 184; 108/60, 108/61

[56] References Cited

U.S. PATENT DOCUMENTS

| | | | |
|---|---|---|---|
| 305,863 | 9/1884 | Thompson | 108/61 |
| 388,674 | 8/1888 | Harrington | 211/43 |
| 452,673 | 5/1891 | Hunter | 108/61 |
| 575,294 | 1/1897 | Borden | 211/184 |
| 679,054 | 7/1901 | Kraushaar | 211/184 |
| 767,037 | 8/1904 | Brett . | |
| 989,566 | 4/1911 | Callaghan | 108/61 |
| 1,675,269 | 6/1928 | Hine | 211/184 |
| 3,501,019 | 3/1970 | Armstrong et al. | 211/184 |
| 3,830,169 | 8/1974 | Madey | 108/61 |
| 3,921,811 | 11/1975 | Dameron | 108/61 |

FOREIGN PATENT DOCUMENTS

| | | | |
|---|---|---|---|
| 107772 | 7/1967 | Denmark | 211/184 |
| 2000290 | 7/1971 | Fed. Rep. of Germany | 211/184 |
| 2011792 | 10/1971 | Fed. Rep. of Germany | 211/184 |
| 109121 | 11/1943 | Sweden | 211/43 |
| 844324 | 8/1960 | United Kingdom | 211/184 |

*Primary Examiner*—James L. Ridgill, Jr.
*Attorney, Agent, or Firm*—Ancel W. Lewis, Jr.

[57] ABSTRACT

A clip-on book end which includes a clip-on base portion connected at an offset location to the bottom corner of a book support portion with the two portions formed as a one-piece molded plastic unit. The clip-on base portion has a resilient clip section opposite and in spaced relation to a bottom surface of the support defining a shelf-receiving passage with an opening at one end through which the end portion of a bookshelf is passed and received with the resilient clip section spreading apart to accommodate shelves of different thicknesses. The clip section has a gripping surface opposite a surface extending along the bottom of the support portion which is constructed and arranged such that laterally directed side loads on the book support portion, as would occur with a tipped row of books, tend to bind the base portion to the bookshelf and maintain the book end in an upright position. In addition, the support portion has a width in relation to its thickness that prevents the exposed pages of a book from being damaged by jamming a book into the support portion during reshelving. The clip-on base portion forms a U-shaped passage that may house the depending edge wall and flange of a metal book shelf while permitting the clip section to close snugly on the much thinner sheet material of the main shelf area. Flanges of differing length are accommodated by removal or replacement of an insert at the lower edge of the U-shaped passage mouth.

7 Claims, 11 Drawing Figures

CLIP-ON BOOK END

CROSS-REFERENCES TO RELATED APPLICATIONS

This is a continuation-in-part of patent application Ser. No. 909,639, filed May 26, 1978, now abandoned.

FIELD OF THE INVENTION

This invention generally relates to supports for shelved books and more particularly to a novel and improved clip-on book end that is releasably secured to a bookshelf.

BACKGROUND OF THE INVENTION

A variety of book ends or book supports have heretofore been provided for supporting books on a shelf. Among the most commonly utilized book ends are metal T-shaped book ends. These book ends typically have a base portion which is slid under an end book of a row of books and an upright support perpendicular to the base located in the center of the base portion which contacts the outside cover of the end book to support the books in an upright position. A problem with this type of book end is that, unless it is positioned squarely against the books, it is not able to support a row of books in an upright position. Thus if a book is removed from a row of books the book end must be repositioned squarely against the end book or the books will tend to slide and tip the book end. Another deficiency with this type of book end is a problem which is referred to as "knifing". Knifing occurs when a book is carelessly reshelved and the exposed closed pages of the book are forced against the upright support portion of the book end. If the upright support is relatively thin, as in these book ends, the upright support will knife through the book and tear and fold the pages. Another limitation with this type of book end is that, to support large or heavy books, different sized book ends with larger base portions must be utilized.

Clip-on book ends are known that engage the edge of a book shelf to varying degrees. Especially with metal book shelves, a clip-on book end have a problem obtaining a firm grip on the shelf because of the thinness of the sheet metal coupled with the flange or channel commonly formed at the shelf edge to provide reinforcement. The clip portion of a clip-on book end is opened only slightly when engaging the sheet material of the main shelf area and accordingly the grip is quite weak. Under such circumstances, a clip-on book end may tend to skew under the lateral pressure exerted by a row of books.

Some early attempts were made to provide a clip-on type book end such as those disclosed in U.S. Pat. Nos. 305,863, 452,673, 575,294, 679,054, and 767,037, but these apparently are not being used commercially at the present time.

Accordingly, it is an object of the present invention to provide a novel and improved device for supporting books on a shelf or the like.

Another object of this invention is to provide a simple, durable and highly versatile book end that is usable on bookshelves of different widths and thicknesses with the book support and base portions readily fabricated as a one-piece molded plastic unit.

Still another object of the present invention is to provide a book end for supporting books on a shelf that can be readily secured to the shelf and having a clip-on base constructed and arranged to resist the weight of the books and maintain the book-contacting support portion and books in an upright position.

Yet another object of the present invention is to provide a versatile book end with an upright support for the books that is constructed and arranged to prevent knifing of the books during reshelving.

A further object of the present invention is to provide a one-piece book end characterized by the use of a clip-on base portion with an integral clip section opposite and spaced from the bottom and to one side of the geometric center of the book support portion with a gripping surface of greater lateral extent than an opposite surface along the bottom of the support portion to resist laterally directed forces on the support portion.

An important object of the invention is to provide a clip-on book end that resists skewing under lateral pressures, expecially when the book end is applied to a formed metal book shelf of the type having a flanged edge.

Other objects, advantages and capabilities of the present invention will become more apparent as the description proceeds, taken in conjunction with the accompanying drawings in which like parts have similar reference numerals and in which.

SUMMARY OF THE INVENTION

Figure 1:
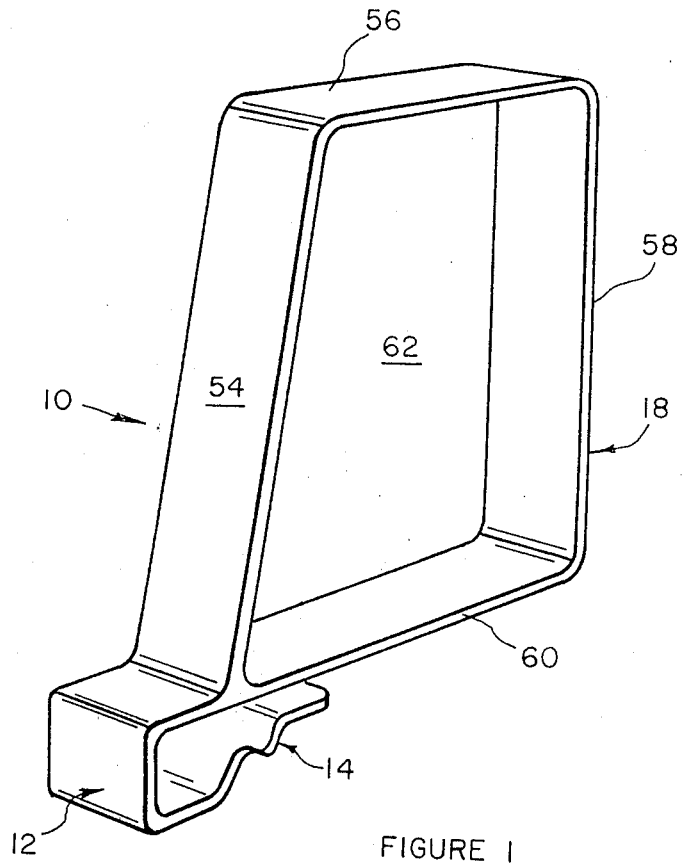
FIG. 1 is a perspective view of a book end embodying features of the present invention.

A book end includes a clip-on base portion connected to and offset from a book support portion with the two portions fabricated as a one-piece unit, preferably of molded plastic. The base portion is formed with an integral resilient clip section for releasably securing the support portion to a bookshelf. The support portion is offset from the base portion so that the support portion is located in line with the center of the books being supported. In addition, the support portion has a thickness which prevents the exposed pages of a book from being damaged by jamming a book into the book end. The resilient clip section is constructed to secure the book end to shelves having a wide range of thickness and is shaped such that laterally directed side loads on a book end, as would occur with a tipped row of books, tend to produce a binding action between the clip-on base and the bookshelf and maintain the book support portion in an upright position. A further embodiment of the book end may include a flange receiving gap for application to metal book ends, wherein the width of the gap is selectively adjustable by removal or replacement of an insert to closely fit the flange thickness of a particular shelf structure.

DESCRIPTION OF THE PREFERRED EMBODIMENTS

Referring now to the drawings, the book end shown is of a unitary or one-piece construction and in general includes a clip-on base portion 12 connected at the bottom and one end edge portion of a book support portion 18 constructed and arranged so that, when the base portion 12 is clipped onto a side portion of a bookshelf, the book support portion is maintained generally upright.

The clip-on base portion 12 includes a substantially straight upper section 22 connected at one end to the support and extending directly out and in line with the bottom of the support portion 18, a substantially straight end section 24 extending at right angles to the upper section 22 opposite its connection to the book support portion, and a substantially straight lower section 26 extending back at right angles to the end section 24 and parallel to the upper section 22. The upper section 22, end section 24, and lower section 26 are formed continuously with one another so as to be in the nature of a shaped strip of material having the same rectangular cross section and all have an equal width. The inside edges 28, 30, 31 formed by the intersection of these sections 22, 24 and 26 are formed with relatively large radiuses to help strengthen the base and to prevent stress points between the different sections.

This construction of sections 22, 24 and 26 forms a generally channel-like or U-shaped passage 32 sized to fit over and cup the top and bottom surfaces of an edge portion of a bookshelf 16 shown in FIG. 5 and described more fully hereinafter. This passage 32 will receive the edge of a bookshelf having a thickness up to equal the distance between the lower surface 34 of the upper section 22 and the upper surface 36 of the lower section. The distance between surfaces 34 and 36 of the base portion is $\frac{7}{8}$ inch in one form of the invention so that the book end 10 will easily fit a wide range of bookshelves having a thickness up to approximately $\frac{3}{4}$ inch.

When the book end is positioned on the bookshelf 16 with the edge of the bookshelf located within passage 32, the clip section functions to releasably fasten or secure the support portion 18 to the bookshelf. The clip section 14 is connected by an inclined resilient segment 38 to one end of lower section 26 that extends at an angle toward the bottom of the book support portion, a straight gripping segment 40 that is parallel to the bottom of the book support portion, and a curved terminal segment 44 that flares away from the book support portion to define a shelf-receiving opening 45. With this configuration the shelf-receiving passage narrows from between parallel sections 22 and 26 and widens slightly at the receiving opening 45 to accommodate shelves of different thicknesses.

Figure 4:
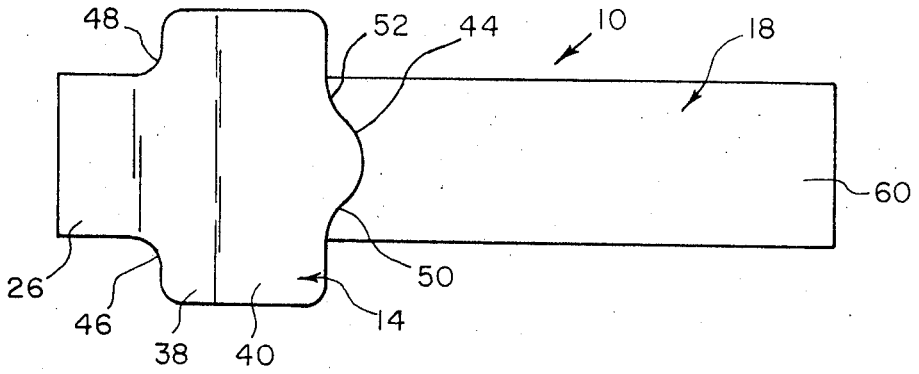
FIG. 4 is a bottom plan view of the book end.

Resilient connecting section 38 is substantially straight and joins the lower section 26 to the gripping segment 40 at an angle to the plane of section 26 and segment 40. In the form shown this angle is approximately 45°. As seen in FIG. 4, the gripping segment 40 has a peripheral configuration with a width that is greater than the width of the lower section 26 and the width of connecting section 38 gradually increases from the width of section 26 to the width of segment 40. Radiused edges 46 and 48 are provided in connecting segment 38 and the gripping segment 40 and help to minimize stress points between the two segments.

Figure 3:
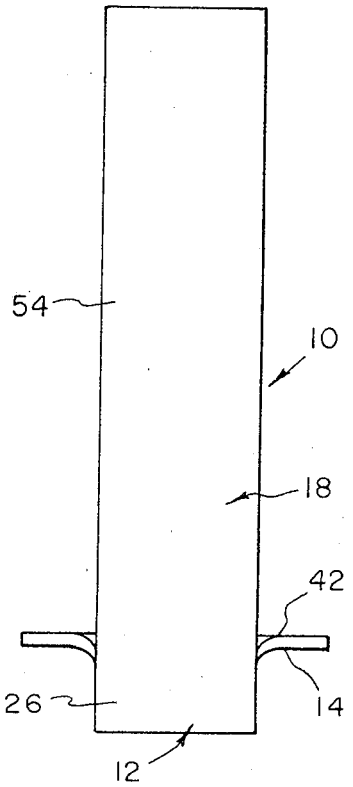
FIG. 3 is an end elevational view of the book end.

The gripping segment 40 has a flat, movable gripping surface 42 located generally parallel to, spaced from, and opposite a stationary surface 49 along the bottom of the support portion 18 at the connecting section 22 to support portion 18. The gripping surface 42 has a relatively large surface area, and as shown in FIG. 3, has a width that projects an equal extent laterally beyond both edges of the book support 18 to resist laterally directed forces on the support 18. In the embodiment shown the gripping surface 42 has a width that is approximately 2.66 times longer than the length of the surface with the width being approximately 3 inches and the length being approximately $1\frac{1}{8}$ inch.

When a relatively stiff plastic material such as polystyrene with a thickness of, for example, $\frac{1}{8}$ inch is utilized as the resilient connecting segment 38, the natural resiliency of the material and the angle of the connecting segment with respect to clip surface 42 will produce a highly effective spring force for releasably clipping the bookshelf between clip surface 42 and the opposite surface 49 along the bottom of the upright support 18. In addition, as will hereinafter be explained, any sideloads on the book end caused by the weight of a row of tipped or partially tipped books 42 tend to produce a binding action between the gripping surface 42, the bookshelf 16 and the opposite surface 49 along the bottom of the support 18.

Figure 2:
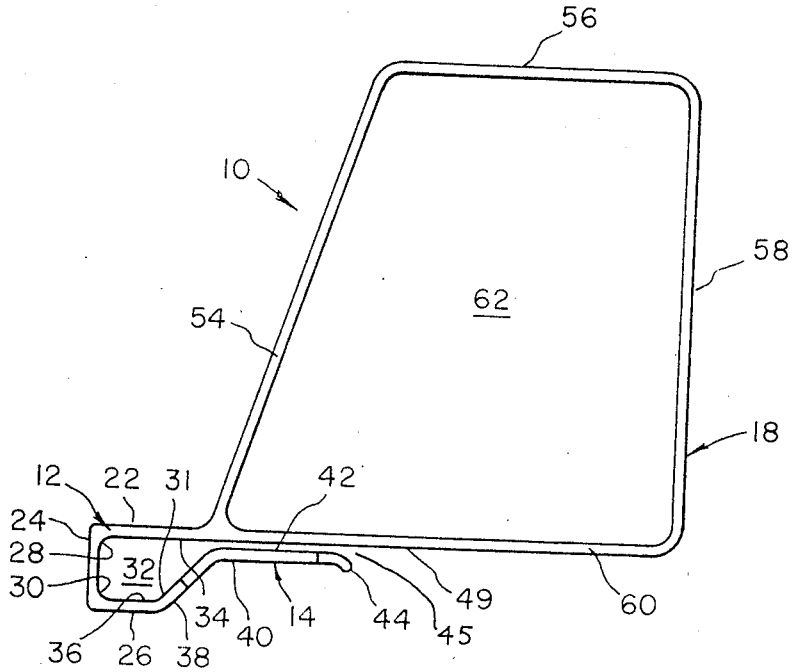
FIG. 2 is a side elevational view of the book end.

The terminal section 44, as shown in FIG. 4, has a generally hemispherical peripheral configuration and is joined to clip surface 42 with radiused edges 50 and 52. In addition, as shown in FIG. 2, the terminal section 44 is curved away from the gripping surface 42 so that the clip section 14 may be more easily slid over the edge of a bookshelf 16.

The book support portion 18 shown secured at its bottom and one end edge portion to the clip-on base portion 12, as above described, then in general has its geometric center offset to one side of the geometric center of the clip-on base portion 12 so that the latter clips on the shelf along one edge portion and the former is centered approximately in the center of the shelf. The support portion 18 is integral or formed continuously with the base portion 12, and with the exception of the gripping segment 40, has the same width and thickness as the base. The support portion 18 shown includes a first side section 54, a top section 56, a second side section 58, and a bottom section 60 arranged in an open framework.

First side section 54 is offset a distance from end edge section 24. This offset arrangement allows the support portion to be more squarely centered relative to the center of a row of books. As shown, this offset distance from end edge section 24 to side section 54 of the upright support 18 is approximately $1\frac{1}{2}$ inches. As shown in FIG. 2, the first side section 54 of the upright support is joined to upper section 22 at an angle to the top edge portion. As shown, the inclusive angle between upper edge section 22 and side section 54 is about 105°. Top section 56 is joined to first side section 54 and is generally parallel to the plane of the upper edge section 22. In addition, the second side section 58 is joined to top section 56 at right angles and bottom section 60 is joined to second side section 58 at right angles.

This construction forms a lightweight, four-sided book support portion with an open center portion 62. The inside edges of the open center portion 62 as well as the outside edges of the upright support are radiused to prevent sharp corners and to minimize stresses between adjacent surfaces. The width of the support portion 18 is substantially the same throughout, and as shown in FIG. 3, is the same as the width of upper edge section 22, end edge section 24, and lower edge section 26 of the base portion 18. In a preferred embodiment of the book end this width is approximately 1½ inches. In any case, this width is large enough to prevent knifing of the books and should be a minimum of approximately ¼ inch. The overall height of the upright support may vary, but in a preferred embodiment is about 5 inches.

Figure 5:
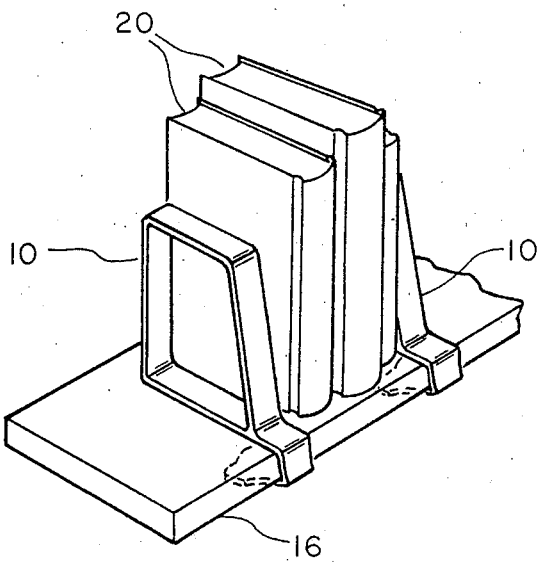
FIG. 5 is a perspective view showing a pair of book ends supporting a row of books on a shelf.

For retaining books on a shelf the book end 10 is clipped as shown in FIG. 5 to a bookshelf 16. The book end rests on the bookshelf 16 on surface 49 along the bottom of the support portion 18 with an edge portion of the bookshelf being disposed within passage 32. The support portion 18, which is offset from the clip-on base portion 12, is centered on the cover of the end book. In this position the resiliency of connecting segment 38 resiliently urges clip surface 42 against the bottom surface of the bookshelf 16 and the opposite surface 49 against the top surface of the bookshelf to firmly secure the book end to the bookshelf.

Laterally directed side loads on the book end from the weight of tipped or partially tipped books is resisted by a binding force between the opposing surfaces 49 and 42 and the bookshelf 16. The binding force is proportional to the side loads imposed on the book end by the books and therefore increases with heavier books or with a completely tipped row of books. The book end will thus support a heavy or tipped row of books without itself tipping, and larger book ends do not need to be utilized for heavier or larger books. If the weight of the books is removed from the book end, however, this binding force will be removed and the book end can be easily pulled from the bookshelf for reshelving the books. In an alternate embodiment, the book support portion 18 may be formed as a solid plate or piece without an open center 62.

With reference to FIGS. 6–11, a modified embodiment of the book end 100 is shown with parts similar to those in the previous embodiment being similarly numbered. In this regard, the book support portion 18 inclusive of sections 54, 56, 58 and 60 may have substantially the same configurations previously described. However, the clip-on base portion 102 is now configured for engaging a wide variety of shelf thicknesses and types with improved overall gripping power. As before, the base has an upper leg section or top wall 22 coplanar with the bottom wall or section 60 of the book support portion 18. In this form sections 22 and 60 have the same thickness which preferably is greater than all other sections of the book end 100. This added thickness has been found to provide the improved characteristics of greater stability and greater strength in book end 100. For example, in one form the thickness of sections 22 and 60 is slightly less than about 3/16 inch while the thickness of the remaining sections is about ⅛ inch to provide a thickness difference of between 1/32 inch to 1/16 inch. The upper leg section 22 is connected at its opposite end from the book support portion to an end leg section 24, which may for convenience of reference to termed the front wall of the base portion; and this front wall depends perpendicularly from the top wall 22 when the clip is in unflexed condition. A lower leg section 26 is connected to the end section and extends beneath and parallel to the upper leg section but spaced therefrom by a distance approximating the maximum thickness of a book shelf with which the book end is intended for use. At the end of the lower leg section 26 opposite from front wall 24, an upwardly extending abutment wall 104 joins the lower leg to a sloping connecting wall 106 having an acute upward and rearward angle to the plane of wall 26. A gripping segment or terminal wall 108 is connected to the rear end of the sloping wall 106 and extends rearwardly and substantially parallel to the plane of wall 60, and may define in combination with wall 60 a receiving opening 45 as previously described.

Figure 7:
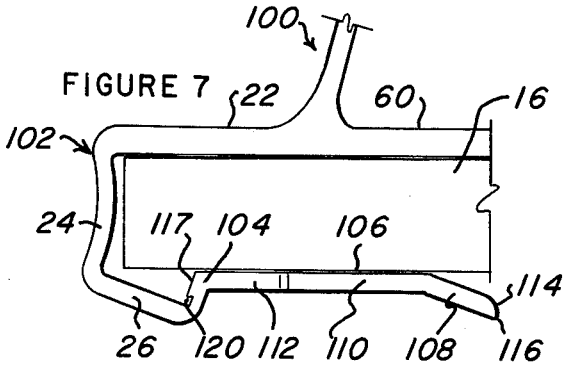
FIG. 7 is an enlarged fragmentary side elevational view of the clip-on base portion of the embodiment of FIG. 6, shown attached to a shelf approximating the maximum thickness for which the book end is adapted.
Figure 6:
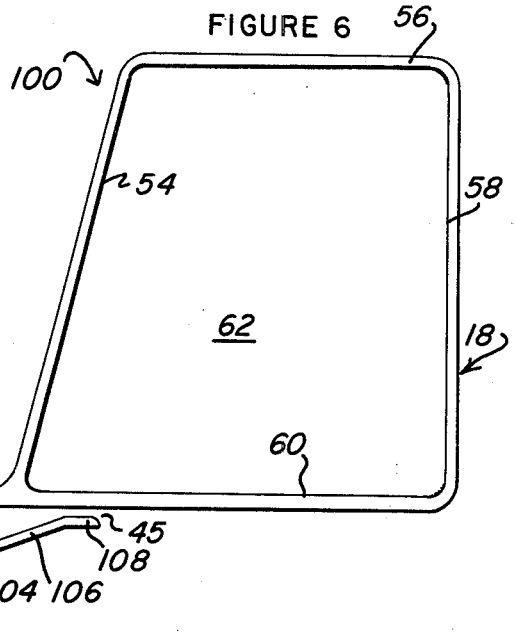
FIG. 6 is a side elevational view of a modified embodiment of the book end.
Figure 8:
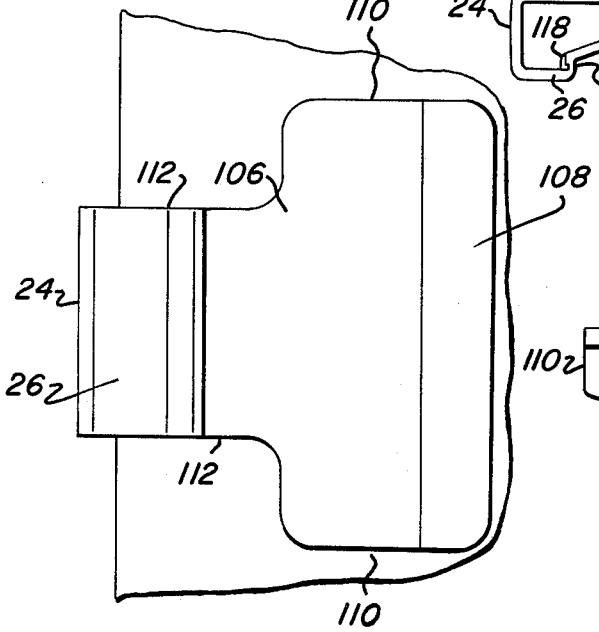
FIG. 8 is a bottom plan view of the book end in FIG. 7.
Figure 9:
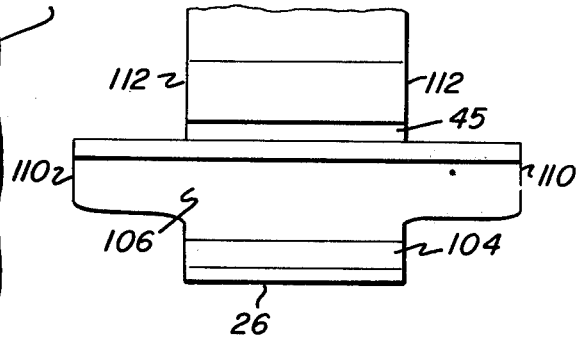
FIG. 9 is an enlarged fragmentary end elevational view taken from the right of FIG. 6.

The connecting wall 106 and the terminal wall 108 together define a gripping portion of the base 102, although the connecting wall 106 in some applications may serve primarily an interchangeable function with the connecting segment 38 of the previous embodiment, as will be subsequently explained. Walls 106 and 108 extend laterally to opposite side edges 110, FIGS. 8 and 9, defining therebetween the gripping surface of the clip-on base. The distance between gripping surface edges 110 is substantially greater, for example twice as great, as the distance between the side edges 112 of the remainder of the book end, including a small portion of wall 106 immediately adjacent to abutment wall 104. The tip 114 of terminal wall 108 is shown in FIGS. 7, 9 and 10 to be smoothly curved from a center of curvature below the midpoint of the wall's thickness, thereby producing a relatively pointed lower corner 116 while the curve may blend smoothly into the upper surface of wall 108 to provide a guiding contour to aid in passing the edge of a shelf through opening 45.

Abutment wall 104 may be quite short, having a vertical height of, for example, one-quarter inch or less above wall 26. This short wall is associated with an insert means for adjusting the distance between the abutment wall and end wall 24 which may be defined as the flange receiving gap. The insert means may be removably attached to the abutment wall or a neighboring structure capable of supporting the insert means adjacent to the front face 117 of the abutment wall. FIG. 11 illustrates one suitable insert means to be a sliding insert 118 generally L-shaped in cross-section as viewed in the figure. A slot 120, best shown in FIGS. 7 and 10, is formed transversely in the abutment wall near the intersection with lower leg 26 and is closely conforming in cross-section to the rib 122, FIG. 11, that defines one leg of the insert. Both the rib 122 and the slot 120 may be dovetailed in shape, or semi-dovetailed wherein the top or bottom surface may diverge rearwardly from parallelism with the other to provide a locking means against removal of the insert from the slot by motion in any but the lateral direction. The other leg 124 of the insert covers the forward face 117 of wall 104 and provides a filler means for reducing the empty space between walls 24 and 104. The length of the insert means generally corresponds to the width of the walls supporting same.

Book end 100 can be applied to either a shelf of constant thickness or to a metal shelf having a thicker forward edge and a relatively thinner main body. In FIG. 7, the result can be seen of applying the book end 100 to a shelf having approximately the maximum constant thickness with which the book end is intended for use, for example a shelf of three-quarter inch thickness. The terminal wall 108 initially guides the shelf between the gripping portion of the book end and the lower wall 60 of book support section 18, but as the shelf enters receiving opening 45, the terminal wall 108 is soon deflected from substantial contact with the shelf. Intermediate connecting wall 106, however, comes into substantial parallel abutment with the lower surface of the book shelf, while wall 60 provides a complementary parallel gripping surface to firmly engage the shelf. In FIG. 7, the broadest portion of wall 106 between edges 110 will be seen to be primarily below the book support section of the book end, rather than directly below the top wall 22 of the base 102. This provides the greatest cooperative interaction of the gripping surfaces directly below the book support section, against which the greatest lateral forces will be applied by a stack of books. The approximate alignment of the gripping surfaces with the lateral forces tends to avoid a tendency for the book end to become skewed with respect to the book shelf.

Figure 10:
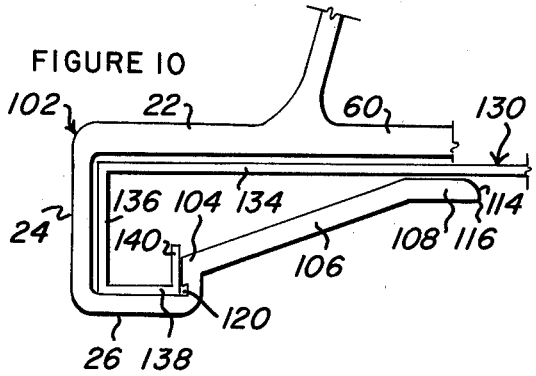
FIG. 10 is a fragmentary side elevational view similar to FIG. 7, but showing the book end attached to a metal shelf with a wide flange.
Figure 11:
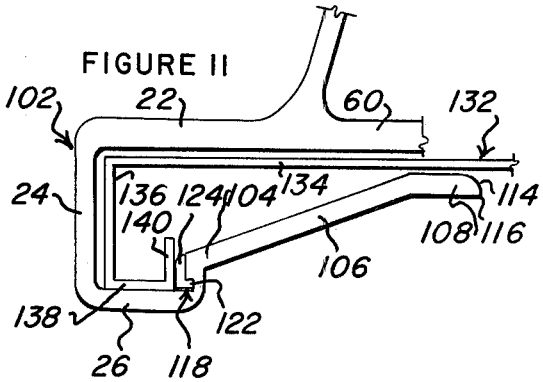
FIG. 11 is a side elevational view similar to FIG. 10, but showing the book end attached to a metal shelf with a narrow flange.

In FIGS. 10 and 11, the interaction of the book end 100 with metal or like book shelves 130 and 132 is shown. The typical metal book shelf is formed with a flat top sheet of material 134 that is bent at its edge to form a depending front wall 136, and then bent at the lower end of wall 136 to form a rearwardly extending flange 138 parallel to top 134. This flange may be bent at its rear edge, producing an upwardly extending lip 140. The distance between lip 140 and front wall 136 defines the thickness of the flange, and this may vary among shelves, but most shelves have a flange thickness of either one-half inch or seven-sixteenths inch. In FIG. 10, shelf 130 has the greater flange thickness, and insert 118 is therefore removed from the book end to leave a suitably large flange receiving gap between walls 24 and 104 to receive the flange. In FIG. 11, the shelf 132 has a relatively smaller flange thickness, and accordingly the insert 118 remains engaged in slot 120 to provide a closer fit. Insert leg 124 should be understood to have a thickness approximating the difference between the flange thicknesses of shelves 130 and 132, which may be one-sixteenth inch. The book end is intended for possible application to shelves of such predetermined flange thickness and is adaptable by insertion or removal of the insert to either of two such standardized sizes. Additional inserts having any required thickness of leg 124 might be provided to adapt the flange receiving gap to any metal shelf of smaller flange thickness than the maximum for which the book end is designed.

The strength of the gripping action between the gripping surface of the clip-on base 100 and the bottom wall 60 is minimal when a metal shelf is engaged, since the base is deflected by only a small amount if at all. The close fit of the shelf flange in the clip-on base augments the strength of the clip in resisting lateral pressure and preventing skewing of the book end on the shelf. In either FIG. 10 or 11, the terminal wall or gripping segment 108 is shown to be substantially parallel with the shelf top 134 and wall 60. Because this terminal wall is closer than wall 106 to the center of the book support section 18, lateral forces are less able to induce skewing of the book end than in gripping arrangement of FIG. 7, resulting in continued good resistance of lateral forces despite the less firm grip on the shelf by the terminal wall. It is in this instance that the intermediate connecting wall 106 serves primarily the same connecting function as wall 38 of the first embodiment.

Although the present invention has been described with a certain degree of particularity, it is understood that the present disclosure has been made by way of example and that changes in details of structure may be made without departing from the spirit thereof.

What is claimed is:

1. A clip-on book end of the type adapted to engage the edge of a shelf, comprising:

a book support portion having a top, front and rear opposed sides with end edges, and a bottom having a bottom surface;

a clip-on base portion connected to the book support portion and offset therefrom, having an upper leg and a lower leg connected by an end wall and defining a channel shaped passage with a shelf-receiving opening opposite from the end wall, the bottom surface of the upper leg being substantially coplanar with said bottom surface of the book support portion, and further having a substantially upstanding abutment wall connected to the lower leg at a spaced position from said end wall and defining therewith a flange-receiving gap, said abutment wall being connected to a connecting segment angling upwardly and away from the end wall and supporting a gripping segment having an upper gripping surface that, with the clip is in unflexed condition, lies between the planes of the book support portion bottom surface and lower leg upper surface, said gripping segment and at least a portion of said connecting segment extending laterally symmetrically beyond said end edges of the book support portion, the base portion further having a sliding insert filler means the horizontal length of said flange receiving gap to closely engage, in use, the edge flange of a shelf formed from sheet material; and wherein the book support portion and base portion are formed from a flexible and resilient material enabling the connecting segment and gripping segment to be spread from the book support portion bottom wall when, in use, a shelf is being received therebetween, and enabling the connecting segment and gripping segment to apply sufficient resilient gripping force, in combination with the book support portion bottom surface, to urge the book support portion toward a substantially upright position on the shelf against lateral loading of the book support portion.

2. The book end of claim 1, wherein said base portion further comprises means for permitting removal and replacement of said sliding insert filler means.

3. The book end of claim 1, wherein said sliding insert filler means comprises an insert having a retaining rib, and said base portion further comprises a lateral slot shaped complementarily to the retaining rib for sliding receipt thereof.

4. The book end of claim 3, wherein said rib and slot are shaped for interlocking engagement against relative motion except longitudinally relative to the length of the slot.

5. The book end of claim 4, wherein said slot and rib have a complementary semi-dovetail cross-section relative to the lengths thereof.

6. The book end of claim 3, wherein said slot is laterally disposed in the face of said abutment wall opposed to said end wall.

7. The book end of claim 6, wherein said insert is L-shaped with one leg thereof comprising said retaining rib and the other leg thereof comprising an extension of said abutment wall toward said end wall.

* * * * *